US007032319B2

(12) United States Patent
Øllgaard et al.

(10) Patent No.: US 7,032,319 B2
(45) Date of Patent: Apr. 25, 2006

(54) RULER WITH ANTI-SLIPPING MEMBER

(76) Inventors: Nis Øllgaard, Præstehaven 23, 8210 Aarhus V (DK); Jørn B. Johansen, Pottemagertoften 126, 8270 Højbjerg (DK)

( * ) Notice: Subject to any disclaimer, the term of this patent is extended or adjusted under 35 U.S.C. 154(b) by 0 days.

(21) Appl. No.: 10/503,553

(22) PCT Filed: Feb. 4, 2003

(86) PCT No.: PCT/DK03/00068

§ 371 (c)(1),
(2), (4) Date: Aug. 4, 2004

(87) PCT Pub. No.: WO03/066348

PCT Pub. Date: Aug. 14, 2003

(65) Prior Publication Data

US 2005/0086819 A1 Apr. 28, 2005

(30) Foreign Application Priority Data

Feb. 4, 2002 (DK) ..... 2002 00164

(51) Int. Cl.
*B43L 12/00* (2006.01)
*B43L 7/00* (2006.01)

(52) U.S. Cl. ..... 33/483; 33/493

(58) Field of Classification Search ..... 33/483–485, 33/489, 492, 493
See application file for complete search history.

(56) References Cited

U.S. PATENT DOCUMENTS

| | | | | |
|---|---|---|---|---|
| 426,138 | A * | 4/1890 | Osborn | 33/485 |
| 566,195 | A | 8/1896 | Leavitt | |
| 806,546 | A * | 12/1905 | Lawless | 33/493 |
| 864,398 | A | 8/1907 | Weston | |
| 1,343,968 | A * | 6/1920 | Hahn | 33/489 |
| 2,230,010 | A * | 1/1941 | Owens | 33/489 |
| 2,303,574 | A * | 12/1942 | Nail | 33/485 |
| 2,522,908 | A * | 9/1950 | Szabo | 33/489 |
| 3,738,010 | A * | 6/1973 | Carder | 33/489 |
| 4,087,917 | A | 5/1978 | Sheerer | |
| 4,349,966 | A * | 9/1982 | Marino et al. | 33/489 |
| 5,615,488 | A * | 4/1997 | Brady | 33/484 |
| 6,349,479 | B1 * | 2/2002 | Bottega | 33/492 |
| 6,594,939 | B1 * | 7/2003 | Ondusko | 33/484 |

FOREIGN PATENT DOCUMENTS

| | | |
|---|---|---|
| BE | 518765 A | 5/1953 |
| DE | 1 904 035 A | 8/1970 |
| DE | 30 11 535 A1 | 1/1981 |
| DE | 30 38 485 A1 | 5/1982 |

(Continued)

*Primary Examiner*—G. Bradley Bennett
(74) *Attorney, Agent, or Firm*—Antonelli, Terry, Stout and Kraus, LLP.

(57) ABSTRACT

A ruler (2) is disclosed, for desk use having an elongated ruler body (4) with a cross-sectional profile enabling at least one part of the ruler body to be placed either at a distance from the underlying layer or in contact with the underlying layer. The ruler, because of an elasticity thereof of the cross sectional profile, facilitates, the at least one part of the ruler body comprising anti-skid means (20) to establish a frictional engagement with the underlying layer by compressive deformation of the ruler body (2), so that the ruler is fixed in relation to the underlying layer. The ruler by simple means and measures easily and efficiently, solely, by the compressive deformation of the ruler body, is fixed in relation to the underlying layer.

12 Claims, 7 Drawing Sheets

FOREIGN PATENT DOCUMENTS

| | | | |
|---|---|---|---|
| DE | 31 06 176 | A1 | 9/1982 |
| DK | 96 00160 | U3 | 8/1996 |
| FR | 2584657 | A1 * | 1/1987 |
| GB | 1 578 341 | A | 11/1980 |
| GB | 2 351 705 | A | 1/2001 |
| JP | 57-15300 | | 9/1982 |
| JP | 8-258490 | | 10/1996 |
| JP | 2002-98501 | | 4/2002 |

* cited by examiner 88
90
84
86
90

88
84
84
90
86

88
86

RULER WITH ANTI-SLIPPING MEMBER

BACKGROUND OF THE INVENTION

1. Field of the Invention

The present invention relates to a ruler, in particular a drawing ruler.

2. Description of the Prior Art

Many types of rulers for drawing are known, and it is likewise well-known to make rulers skid-resistant, both by means of active (movable) anti-skid means or by means of passive anti-skid means (friction strips).

Rulers are typically used as measuring, cutting, and drawing tools, in that various types of writing or cutting tools are used together with the ruler, for which reason it is important to be able to fix the ruler efficiently to the underlying layer.

SUMMARY OF THE INVENTION

The invention provides an improved ruler of the type mentioned above, and which by simple means and measures makes it easy to efficiently fix the ruler in relation to an underlying layer.

The ruler according to the invention preferably has central parts of the ruler body comprising anti-skid means for establishing a frictional engagement with the underlying layer by compressive deformation of the ruler body, so that the ruler is fixed in relation to the underlying layer. A ruler is achieved, which by simple means and measures easily and efficiently, solely by the compressive deformation of the ruler body, can be fixed in relation to the underlying layer.

In a preferred embodiment of a ruler according to the invention the anti-skid measures are constituted by a relatively soft friction material, preferably provided both at the upper side and the underside of the parts of the ruler body, and which frictional material by moulding has been integrated with the ruler, in that parts of the friction material extend through holes or recesses in the parts of the ruler body. The desired frictional effect by the use of hard and soft friction materials respectively can be achieved by a moulding or a extrusion process. The hard material may be either plastics or metal.

In an alternative preferred embodiment of a ruler according to the invention the anti-skid means are constituted by a relatively soft friction material preferably provided both at the upper side and the underside of the parts of the ruler body, and which has been fastened to the ruler by pressing projecting parts of the friction material through holes or recesses in the parts of the ruler body.

In a particularly simple embodiment of a ruler according to the invention the anti-skid means are constituted by a relatively soft friction material provided only at the underside of the parts of the ruler body, and which material in a suitable way has been fastened to the ruler. Friction material can be connected with the ruler body by means of glue, adhesive tape, or staples. Alternatively, the friction material may be embedded in special countersunk retaining tracks in the underside of the ruler body. In a further alternative embodiment, the ruler may have a central longitudinal strip of relatively soft friction material inserted between and connecting longitudinal inflexible edge parts of the ruler body, so that the ruler appears as an integral, elastic unit having a longitudinal, central friction body.

The ruler according to the invention may furthermore be shaped in such a way that the anti-skid means are constituted by a strip having a predominantly triangular cross section and, towards the bottom, a rounded tapered end, which strip at the underside of the parts of the ruler body predominantly extends along the entire ruler.

A further preferred embodiment of the ruler according to the invention is suitably shaped in such a way that the cross-section of the ruler body extending from a longitudinal side edge, which edge in the situation of use constitutes the active drawing, cutting, and/or measuring edge of the ruler, and towards a second longitudinal side edge has a slightly sloping course, that is an increasing distance between the underside of the ruler body and the underlying layer, that the ruler close to the second longitudinal side edge towards the bottom has a longitudinal support strip constituting an integral part of the ruler body, and that the anti-skid means are provided approximately in the middle between the longitudinal side edges.

Quite generally, the ruler according to the invention is shaped in such a way that the elasticity of the ruler body, in addition to choice of material, is determined by material thickness and/or of the number and sizes of holes in the central part of the ruler body. Furthermore, the elasticity of the ruler body may preferably be determined by local thickness reduction of the material opposite the holes or recesses in the central part of the ruler body.

In an especially simple way the desired effect of the ruler according to the invention can be achieved by the anti-ski means being constituted by a number of holes or recesses intended for receiving a finger tip which by the compressive deformation of the ruler exerts the frictional engagement with the underlying layer.

Alternatively the ruler according to the invention is shaped so that the anti-skid means are constituted by a rough and/or fluted surface provided on the underside of preferably central parts of the ruler body. Thus the ruler has no movable and consists of one part.

The invention furthermore relates to a ruler for board use having a long body with a cross section or cross-sectional profile and a longitudinal section or a longitudinal profile enabling one or more preferably central parts of the ruler body to be placed either at a distance from the board surface or in contact with the board surface, in that the ruler, because of material and/or the cross-sectional and longitudinal profiles has a certain elasticity, which ruler is has the parts of the ruler body comprise anti-skid means for establishing a frictional engagement with the board surface by compressive deformation of the ruler, so that the ruler is fixed in relation to the board surface.

As a result a so-called metric ruler for board use is achieved, which ruler is manufactured according to the same principles as those for the desk ruler; but which furthermore has a longitudinal section or longitudinal profile enabling a central part in the longitudinal direction of the ruler body to be placed at a distance from the underlying layer (the board) or in contact with the board, in that the frictional engagement with the board is established by compressive deformation of the ruler body.

BRIEF DESCRIPTION OF THE DRAWINGS

The invention is explained in more detail below in connection with the drawing in which.

DESCRIPTION OF THE PREFERRED EMBODIMENTS

Figure 5:
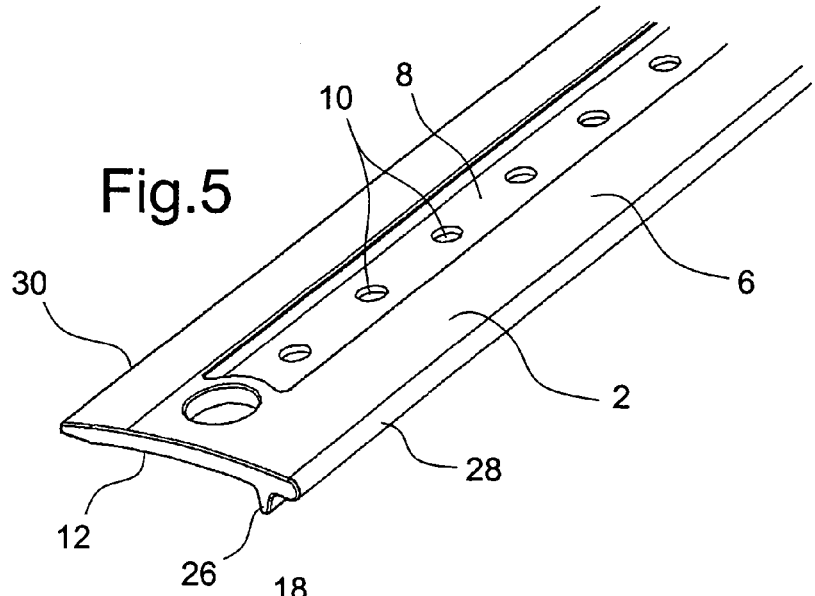
FIG. 5 shows a perspective view of an end part of the ruler according to the invention shown in FIG. 1, with no friction body.
Figure 6:
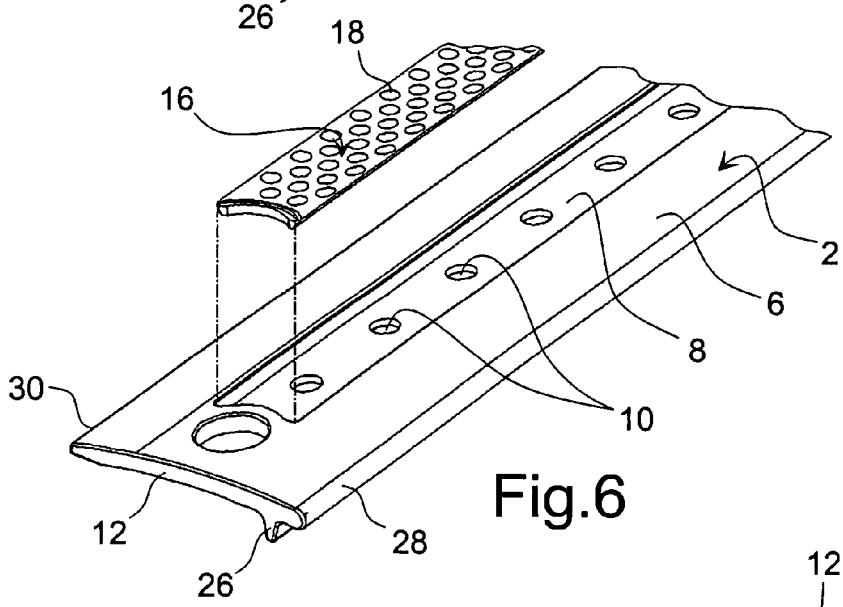
FIG. 6 shows a perspective view of an end part and corresponding friction body of the ruler according to the invention shown in FIG. 1.
Figure 7:
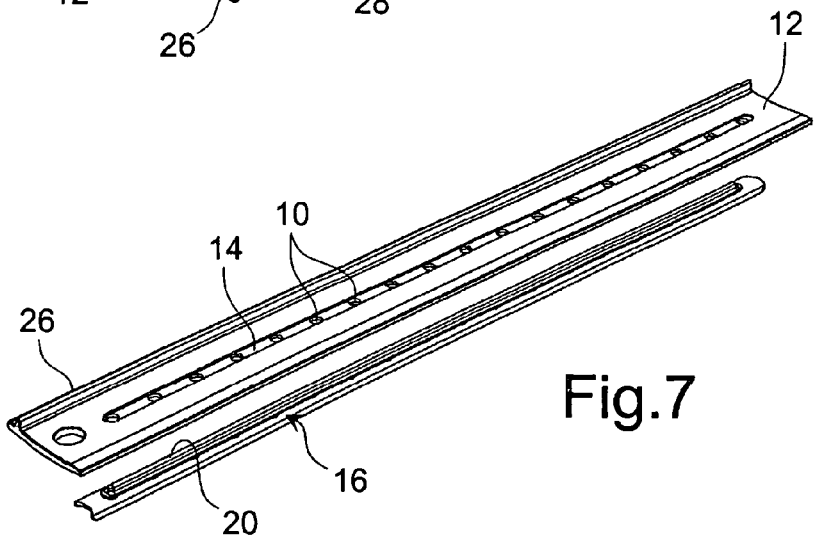
FIG. 7 shows a perspective view of a ruler seen from below, and corresponding friction body.

The ruler 2 shown in FIGS. 1–7 includes a ruler body 4 having a slightly convex curved upper side 6 in which a longitudinal central cavity 8 is formed with a number of holes 10 (FIGS. 5, 6, and 7). On its slightly concavely curved underside 12, the ruler body 4 has an oblong central cavity 14, containing the holes 10.

Figure 1:
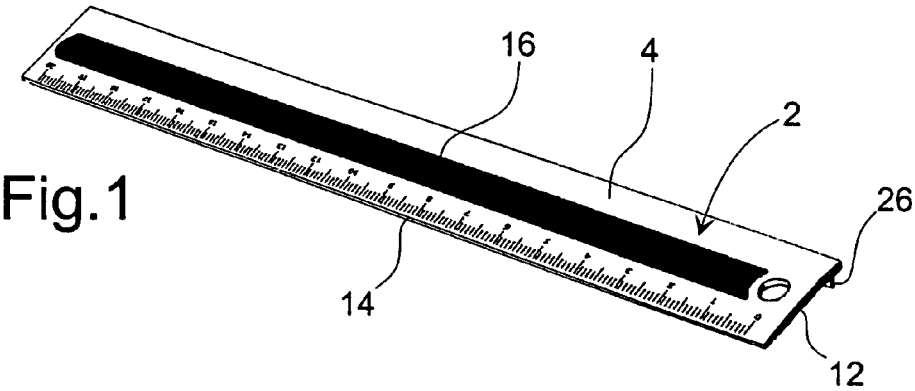
FIG. 1 shows a perspective view of a preferred embodiment of a ruler for desk use according to the invention.
Figure 2:
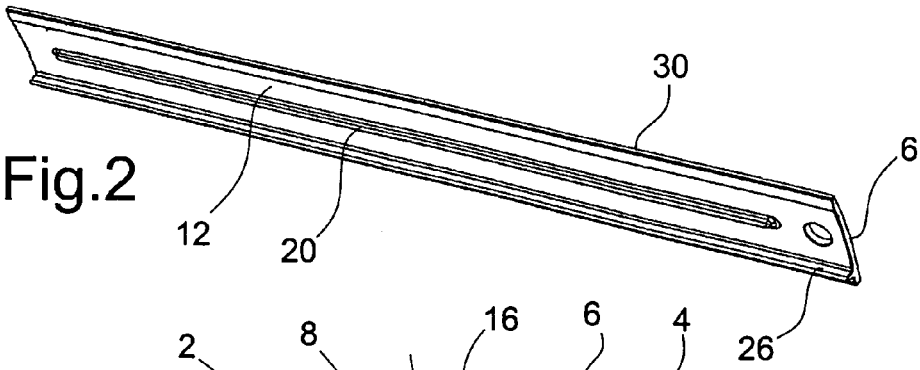
FIG. 2 shows a perspective view of the ruler shown in FIG. 1, seen from below.
Figure 3:
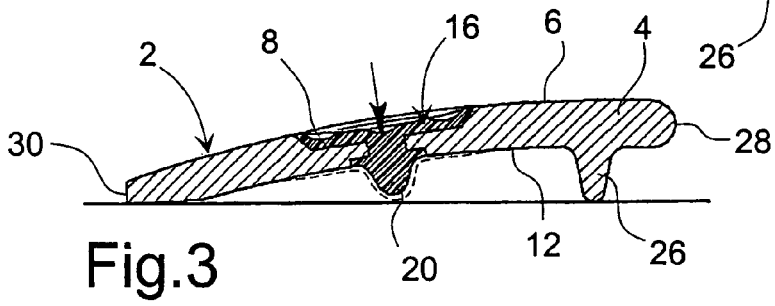
FIG. 3 shows a sectional view through the ruler according to the invention shown in FIG. 1.
Figure 4:
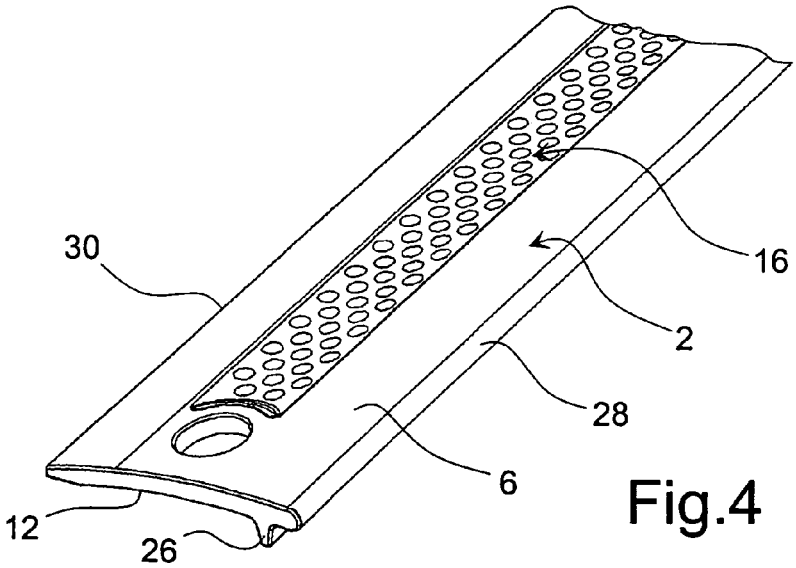
FIG. 4 shows a perspective view of an end part of the ruler according to the invention shown in FIG. 1.

The cavities 8 and 14 on the upper side 6 and the underside 12 respectively of the ruler body 4 are filled in by a friction body 16 (shown separately in FIGS. 6 and 7) of relatively soft material. The friction body 16 is preferably moulded onto the ruler body 4 in such a way that the friction body 16 on the upper side of the ruler 2 forms a central, longitudinal activation surface 18, and so that the friction body 16 on the underside of the ruler 2 forms a central, longitudinal friction strip 20, which by compressive deformation of the ruler body 4, as indicated by an arrow 22 in FIG. 3, is pressed against the underlying layer 24. The ruler body 4 has a certain elasticity so that the friction strip 20, which by means of a longitudinal support strip 26 at a back side edge 28 has been lifted off the underlying layer 24, by a relatively light pressure on the activation surface 18, can be pressed against the underlying layer for secure fixing of the ruler 2 in relation to the underlying layer 24, during use of an active drawing, cutting, and/or measuring edge 30 of the ruler 2.

Figure 8:
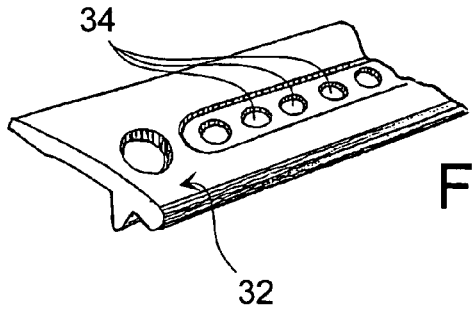
FIG. 8 shows a perspective view of an end part of another embodiment of a ruler according to the invention.
Figure 9:
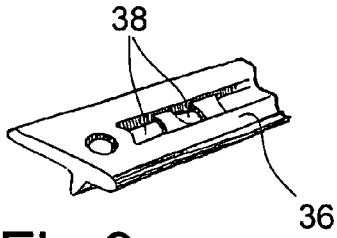
FIG. 9 shows a perspective view of an end part of a further embodiment of a ruler according to the invention.
Figure 10:
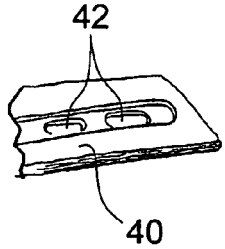
FIG. 10 shows a perspective view of an end part of yet another embodiment of a ruler according to the invention.

FIGS. 8–10 show rulers according to the invention with alternative embodiments of holes, cavities, and recesses. FIG. 8 thus shows a ruler 32 having a large number of holes 34 at the bottom of the central groove. FIG. 9 shows a ruler 36 having more edged holes or recesses 38 so that only very little material is left opposite the friction body 16, that is so that the elasticity of the ruler 36 becomes larger. FIG. 10 shows a ruler 40 with oval or oblong holes or recesses 42 at the bottom of the central longitudinal groove of the upper side of the ruler.

Figure 11:
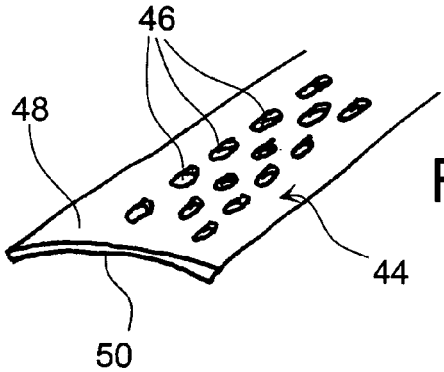
FIG. 11 shows a perspective view of an end part of yet an alternative embodiment of a ruler for desk use according to the invention.

FIG. 11 shows an alternative embodiment of a ruler 44 where the friction body has been replaced by holes or recesses 46 which, by placing of fingers therein, act so that fingers act as friction bodies by engagement with the underlying layer through the holes or recesses. The ruler 44 has a slightly curved convex upper side 48 and a slightly curved concave underside 50.

Figure 12:
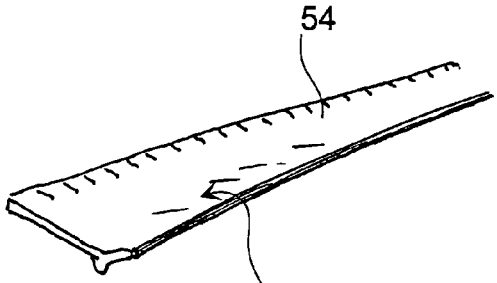
FIG. 12 shows a perspective view of an end part of an embodiment of a ruler for board use according to the invention.

FIG. 12 shows an end part of an embodiment of a one-metre ruler for board use where the ruler body 54 also in its longitudinal direction has such a longitudinal section or longitudinal profile that a central part of the ruler body 54 both can be placed at a distance from the underlying layer (the board) and can be pressed against the underlying layer.

Figure 13:
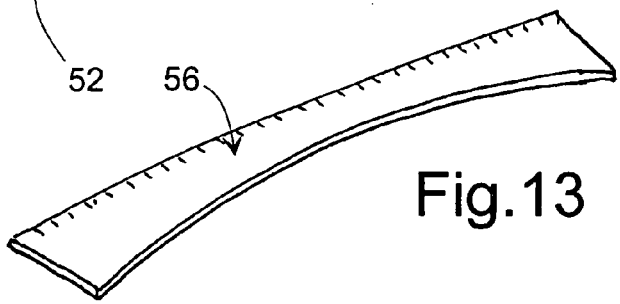
FIG. 13 shows a perspective view of an alternative embodiment of a ruler for board use according to the invention.

FIG. 13 shows another embodiment of a ruler 56 for board use, where it clearly appears that the ruler 56 also in its longitudinal direction has a curved course allowing a central body part of the ruler to be placed both at a distance from and in contact with the underlying layer (the board).

Figure 14A:
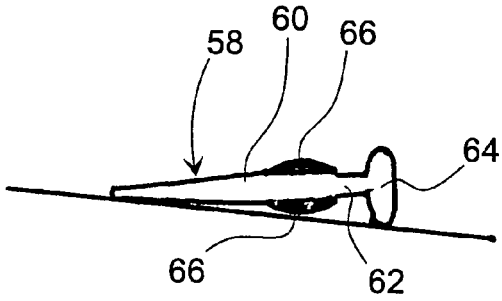
FIG. 14*a* shows an end plane view of yet an alternative embodiment of a ruler according to the invention, seen from an end.
Figure 14B:
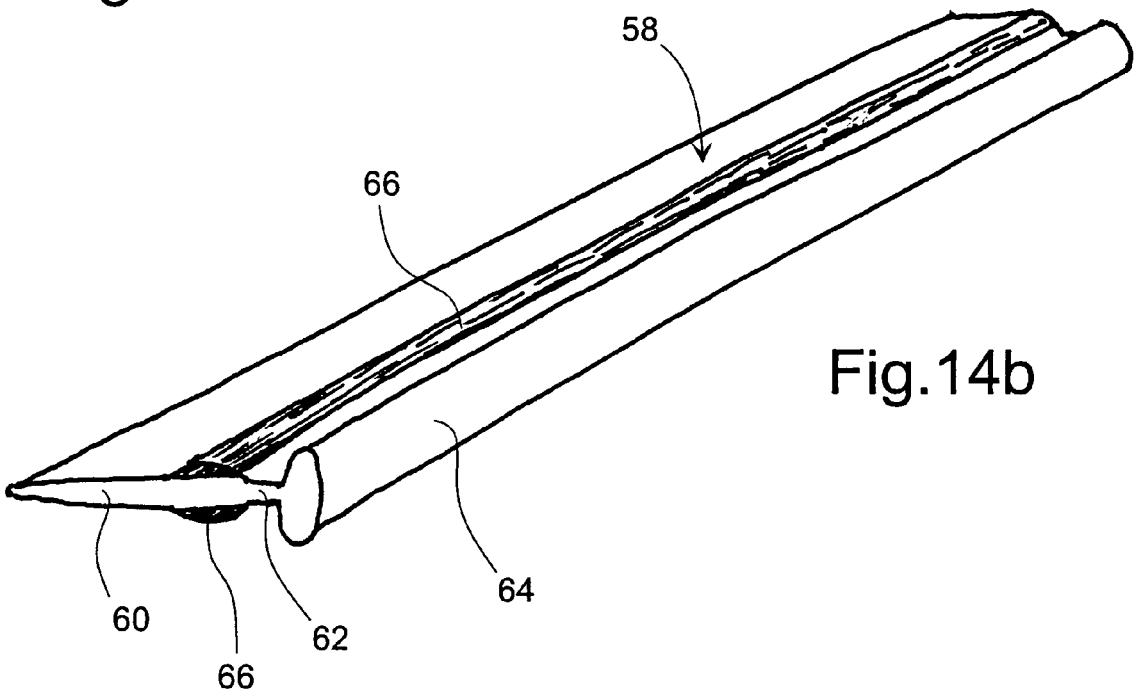
FIG. 14*b* shows a perspective view of the embodiment of FIG. 14*a*.

FIGS. 14*a* and 14*b* show another embodiment of a ruler 58 for desk or table use. The ruler 58 is two-sided, that is it can be provided with mutually different measuring systems on each of its sides, in that a body part 60 of the ruler 58 has a cross section with a narrowing 62 under a wider transverse head part 64, so that the body part 60, which at each of the two sides is provided with a longitudinal anti-skid body 66 so that the bodies by compressive action of the ruler body 60 from an optional side can be pressed against the board or desk surface. In other words, by means of the longitudinal narrowing 62, the desired elasticity of the ruler body 60 is achieved, the body preferably is symmetrical about a longitudinal axis.

Figures 15A, 15B, 15C:
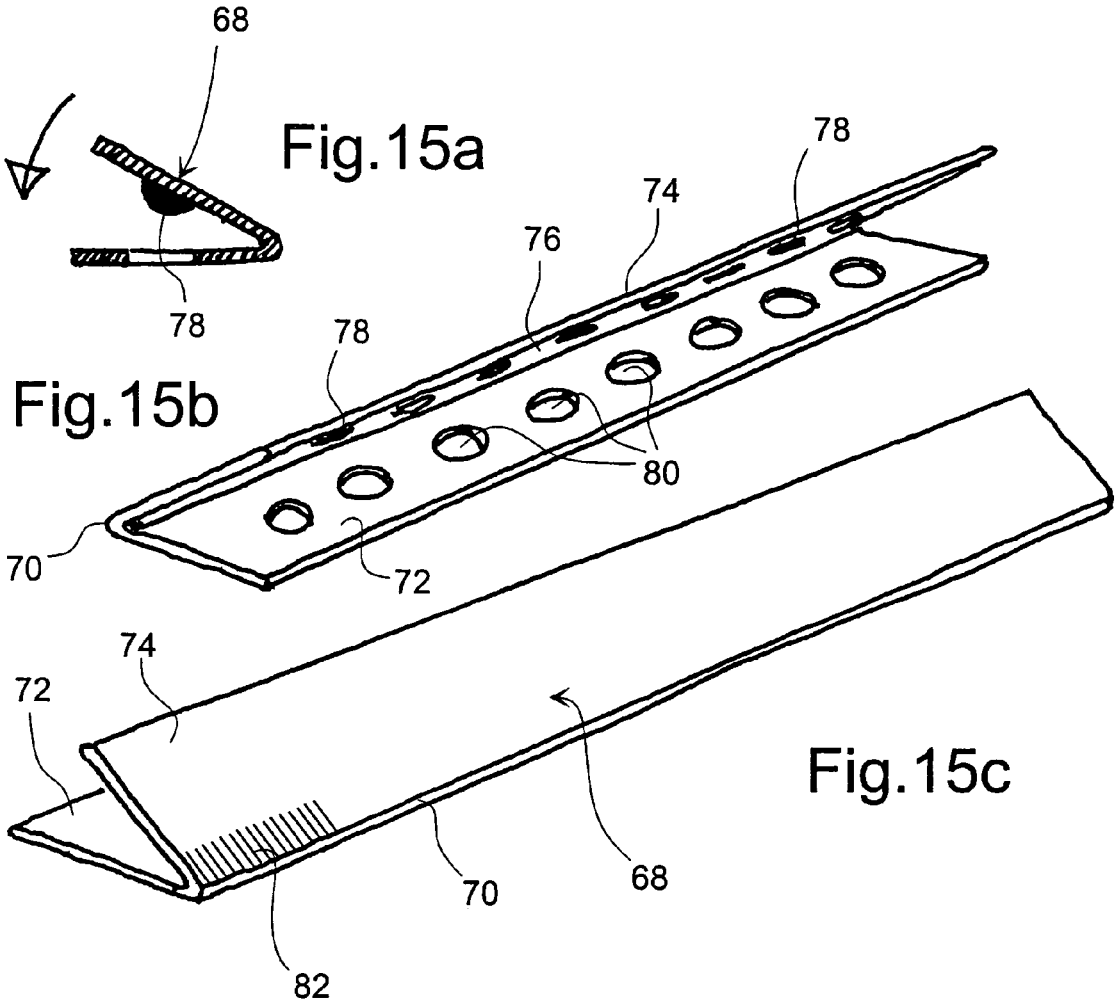
FIG. 15*a* shows a cross-sectional view through yet another embodiment of a ruler according the invention.
FIG. 15*b* shows a perspective view of the ruler, of FIG. 15*a*, seen from a longitudinal side thereof.
FIG. 15*c* shows a perspective view of the ruler, of FIG. 15*b*, seen from the opposite longitudinal side.

FIGS. 15*a*, 15*b*, and 15*c* show an alternative embodiment of a ruler 68 according to the invention for desk or table use where the elasticity of springy effect of the ruler body has been achieved by means of a longitudinal edgewise bend 70 between two longitudinal wings 72, 74 of the ruler 68, that is the ruler wing 72 is adapted to abut against the support surface, while the ruler wing 74 has an acute angle in relation to the ruler wing 72 and has a certain springy effect in relation the ruler wing 74. On its inner side 76, this is provided with a number of projecting anti-skid bodies 78 intended for being pressed against the support surface through holes 80 which are shaped in the ruler wing 72 opposite the anti-skid bodies 78. Preferably, the upper side of the upper side of the ruler wing 74, as shown in FIG. 15*c*, is provided with measurement marks and measurement indicators 82 along the longitudinal closed edge 70, but there is however nothing to prevent the opposite longitudinal side edges at the opposite side of the ruler body from also being provided with measurement marks and/or measurement indicators. The ruler 68 can be manufactured of relatively thin sheet material, for example plastic, metal, or laminated paper suitable for imprinting, and which is relatively inexpensive.

Figures 16A, 16B, 16C:
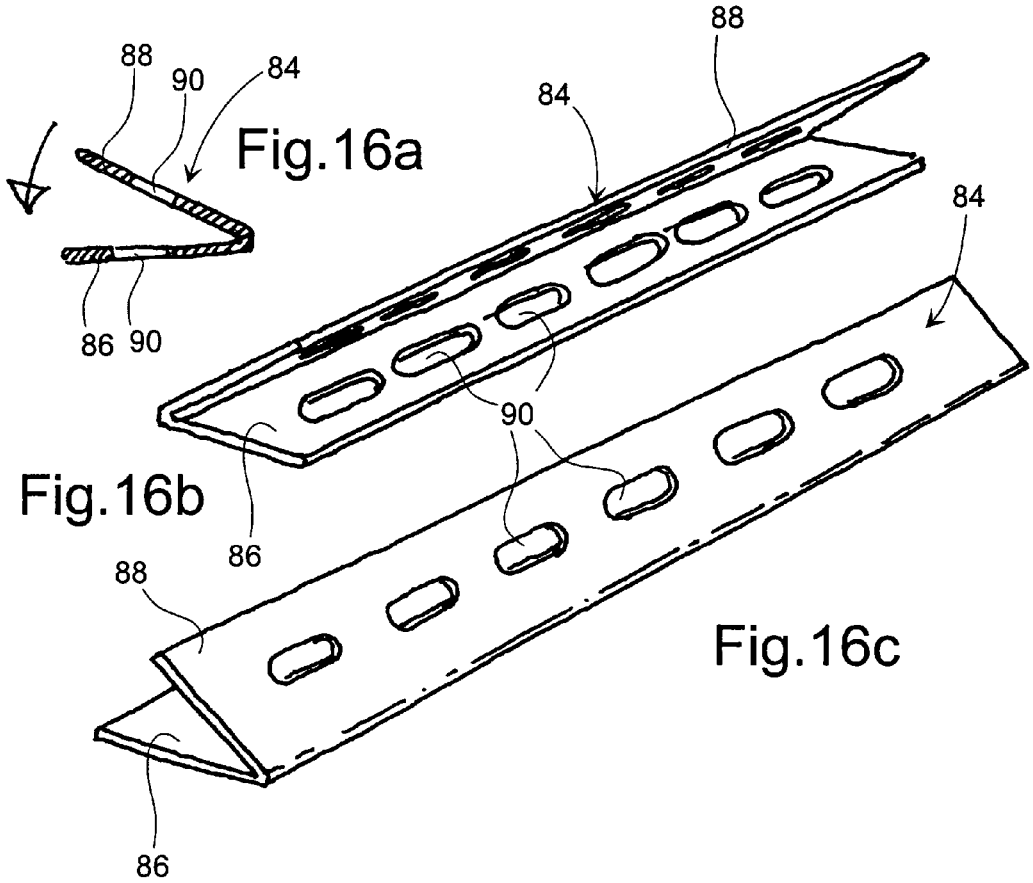
FIG. 16*a* shows a sectional view through yet another embodiment of a ruler according to the invention.
FIG. 16*b* shows a perspective view of the ruler of FIG. 16*a*, seen from a longitudinal side thereof.
FIG. 16*c* shows a perspective view of the ruler, of FIG. 16*b*, seen from the opposite longitudinal side.

FIGS. 16*a*, 16*b*, and 16*c* show a corresponding alternative embodiment of a ruler 84 according to the invention for desk or board use. The ruler 84 has two mutually edgewise bent ruler wings 86 and 88 which both, opposite each other, are shaped with holes 90 so that the upper ruler wing 88 can be pressed down for abutment against the ruler wing 86, and so that the finger tips of the user can be introduced through the holes 90, in the way described above, where the finger tips constitute anti-skid bodies, which through the holes 90 are pressed against the support surface.

Figure 17A:
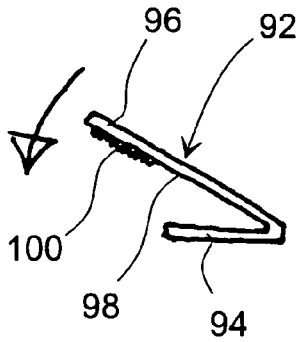
FIG. 17*a* shows a view of yet another embodiment of a ruler according to the invention, seen from an end.
Figure 17B:
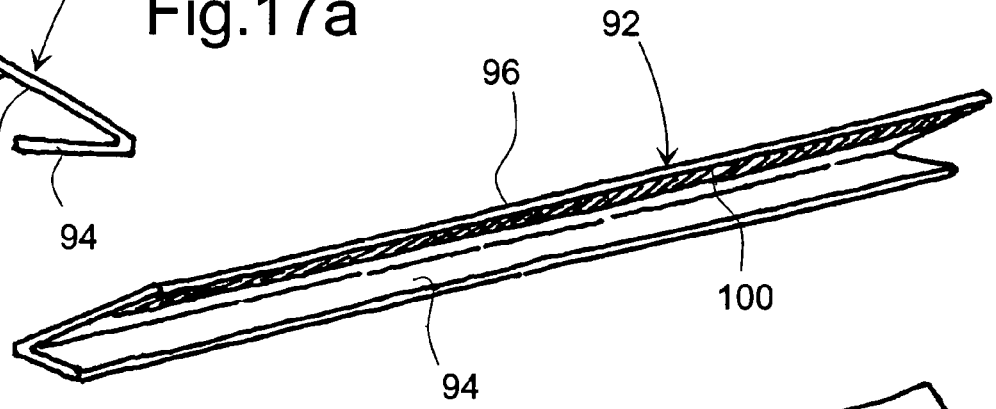
FIG. 17*b* shows a perspective view of the ruler, of FIG. 17*a*, seen from a longitudinal side thereof.
Figure 17C:
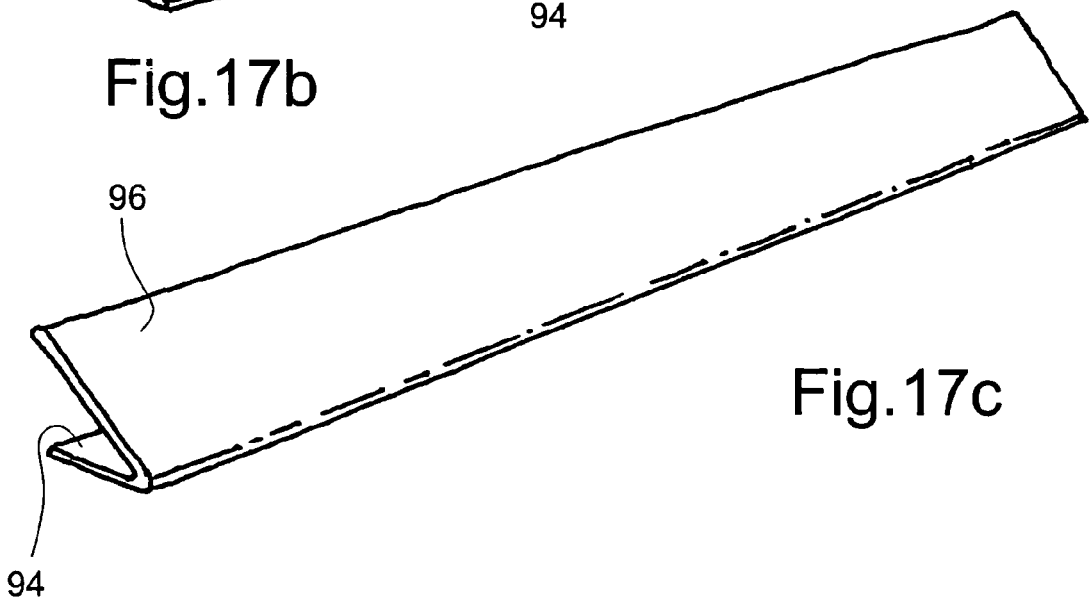
FIG. 17*c* shows a perspective view of the ruler, of FIG. 17*b*, seen from the opposite longitudinal side.

In another alternative embodiment of a ruler 92, which is shown in FIGS. 17*a*, 17*b*, and 17*c*, a lower ruler wing 94 is shaped considerably narrower than an upper ruler wing 96. Along an outer, longitudinal edge area along an inner side 98, the latter is provided with a longitudinal friction body 100 which by downwards pressing of the ruler wing 96 is adapted to be pressed against the support surface. Alternatively, the friction body 100, cf. previously described embodiments, could instead consist of anti-skid bodies that are more pinhead-shaped, or of finger holes so that finger tips can constitute the said anti-skid bodies.

Finally it should be pointed out that the primary aspect of the invention, namely to specify a ruler, where a frictional engagement between the ruler and a support surface can be achieved by compressive deformation of a part of the ruler, can be fulfilled in any other way within the scope of the invention. Maybe a ruler body of non-elastic material opposite a writing edge could be provided with a longitudinal friction lip manufactured of an elastic material, and which in relation to the ruler body extends in a concave curve, so that the friction lip in a state where no pressure is exerted upon it is lifted off the support surface, and so that the friction lip by compressive action fully or partly can be pressed against the support surface.

The invention claimed is:

1. A ruler, having an elongated body with a cross sectional profile enabling at least one part of the ruler body to be placed either at a distance from an underlying layer or in contact with the underlying layer, wherein the cross-sectional profile has an elasticity, at least one part comprising anti-skid means for establishing frictional engagement with the underlying layer by application of a force to a surface of the body to produce a compressive deformation of the body to cause the anti-skid means to move from being at the distance from the underlying layer to contacting the underlying layer and wherein the anti-skid means is fixed integrally in the body to prevent movement of the anti-skid means relative to the body in a direction of application of the force.

2. A ruler according to claim 1, wherein the anti-skid means are a friction material, provided on at least one of an upper side and an underside of central parts of the ruler body, with the friction material being moulding to be integrated with the ruler.

3. A ruler according to claim 2, wherein the friction material extends through holes or recesses in at least one part of the ruler body.

4. A ruler according to claim 1, wherein the anti-skid means is a friction material provided at an upper side and an underside of at least one part of the ruler body, and which friction material is fastened to the ruler by pressing projecting parts of the friction material through holes or recesses in at least one part of the ruler body.

5. A ruler according to claim 1, wherein the anti-skid means are a friction material provided on only an underside of at least one part of the ruler body, and which friction material has been fastened to the ruler.

6. A ruler according to claims 1–3 or 5, wherein the anti-skid means are a strip having a substantially triangular cross section and towards a bottom thereof a rounded tapered end, which strip at an underside of at least one part of the ruler body extends along the ruler.

7. A ruler according to claim 6, wherein the cross-section profile of the ruler body extends from a longitudinal side edge, providing during use a drawing, cutting and/or measuring edge of the ruler, and towards a second longitudinal side edge, has a slope with a distance between an underside of the ruler body and the underlying layer so that the ruler adjacent a second longitudinal side edge towards a bottom thereof has a longitudinal support strip integral with the ruler body, and the anti-skid means are provided in a middle part between longitudinal side edges.

8. A ruler according to claim 1, wherein the elasticity of the ruler body, is determined by at least one material thickness and a number and size of holes or recesses in the central part of the ruler body.

9. A ruler according to claim 8, wherein the elasticity of the ruler body is determined by a thickness reduction of the material opposite the holes or recesses in the central part of the ruler body.

10. A ruler according to claim 1, wherein the anti-skid means comprise holes for receiving a finger tip which by compressive deformation of the ruler exerts the frictional engagement with the underlying layer.

11. A ruler according to claim 1, wherein the anti-skid means comprise one of a rough and fluted surface provided on the underside of central parts of the ruler body.

12. A ruler for board use having an elongated body with a cross-sectional profile and a longitudinal profile enabling at least one central part of the ruler body to be placed either at a distance from a board surface or in contact with the board surface, with the ruler having an elasticity, and the at least one central part of the ruler body comprising anti-skid means for establishing a frictional engagement with the board surface by application of a force to a surface of the body to produce a compressive deformation of the ruler, so that the anti-skid means moves from being at the distance from the broad surface to contacting the board surface wherein the anti-skid means is fixed integrally in the body to prevent movement of the anti-skid means relative to the body in a direction of application of the force.

* * * * *